US006771116B1

(12) United States Patent
Wang et al.

(10) Patent No.: US 6,771,116 B1
(45) Date of Patent: Aug. 3, 2004

(54) CIRCUIT FOR PRODUCING A VOLTAGE REFERENCE INSENSITIVE WITH TEMPERATURE

(75) Inventors: Chin-Hui Wang, Taipei (TW); Liang-Pin Tai, Tainan Hsien (TW)

(73) Assignee: RichTek Technology Corp., Hsinchu (TW)

( * ) Notice: Subject to any disclaimer, the term of this patent is extended or adjusted under 35 U.S.C. 154(b) by 0 days.

(21) Appl. No.: 10/064,267

(22) Filed: Jun. 27, 2002

(51) Int. Cl.[7] ..... G05F 1/10

(52) U.S. Cl. ..... 327/540; 327/541; 323/312; 323/313

(58) Field of Search ..... 327/538, 539, 327/540, 541, 543, 546, 512, 513; 323/312, 313, 314, 315

(56) References Cited

U.S. PATENT DOCUMENTS 5,467,052 A * 11/1995 Tsukada ..... 327/543
5,873,053 A * 2/1999 Pricer et al. ..... 702/130
6,316,971 B1 * 11/2001 Ohashi ..... 327/74

* cited by examiner

*Primary Examiner*—Timothy P. Callahan
*Assistant Examiner*—An T. Luu
(74) *Attorney, Agent, or Firm*—Jianq Chyun IP Office

(57) ABSTRACT

A voltage reference circuit includes a current source unit, a voltage-difference creating unit, and a resistance ratio unit. The current source unit receives an input current source and produces two current sources in equal current. The voltage-difference creating unit includes a first MOS device and a second MOS device to respectively receive the two current sources, wherein the first MOS device and a second MOS device has a threshold voltage difference. The resistance ratio unit includes a first resistor and a second resistor coupled in cascade, wherein the threshold voltage difference is applied to the first resistor. By adjusting a ratio of the first resistor to the second resistor, the resistance ratio unit produces a voltage reference, which is also fed back to the current source unit to ensure that the first current source and the second current source are equal.

7 Claims, 2 Drawing Sheets

CIRCUIT FOR PRODUCING A VOLTAGE REFERENCE INSENSITIVE WITH TEMPERATURE

BACKGROUND OF INVENTION

1. Field of Invention

The present invention relates to technology to design a voltage reference circuit. More particularly, the present invention relates to a circuit for producing a voltage reference that is insensitivity with temperature.

2. Description of Related Art

Voltage reference has been widely used in an analog integrated device. Since all the sub-circuits in the integrated device are influenced by the voltage reference, it is crucial to provide a temperature-insensitive voltage reference. The stable voltage reference is required in various device circuits. For example, a converter needs a stable voltage reference, so as to precisely produce the desired voltage. The output errors can at least be significantly reduced.

The circuit to produce a voltage reference has been introduced since the past many years. Basically, a fixed energy gap, such as $V_{BE}$, for a bipolar transistor is often used to design the circuit to produce the voltage reference. One of the various conventional device with voltage reference is shown in FIG. 1. In FIG. 1, a bipolar transistor 90 is used. The emitter electrode 90*e* is connected to the ground voltage. The collector electrode 90*c* is receiving a current source 92, in which the other terminal of the current source 92 is connected to the voltage source Vcc. The collector electrode 90*c* and the base electrode 90*b* are coupled together and also connected to a sum unit 94. In addition, thermal voltage $V_T$ is generated by a $V_T$ generator 96. The output voltage $V_T$ is then multiplied by a multiplier 98 with a factor of M, so as to obtain a voltage level of $MV_T$. The voltage level $MV_T$ is then also input to the sum unit 94, so that a voltage output Vout is obtained, in which $Vout=V_{BE(ON)}+MV_T$. Since the $V_{BE(ON)}$ has negative temperature coefficient while $V_T$ has positive coefficient, the desired voltage reference insensitive to the temperature can be obtained by choosing appropriate factor M.

For this conventional device with the voltage reference, the voltage difference $V_{BE}$ of the bipolar device is used as the voltage reference. Since the conventional IC fabrication is based on the CMOS process and it is hard to combine a bipolar device in the standard CMOS technology, it is not a good design to have the voltage reference by using a bipolar device. Also and, temperature coefficient of bipolar device is not exactly constant, M can be chosen to set temperature coefficient of output voltage to zero only at one temperature.

In order to produce the stable voltage reference, the conventional band-gap circuit is also proposed. However, the band-gap circuit usually also include two bipolar transistors with different area, so as to adjust the voltage difference. Again, the CMOS process is not convenient to include the bipolar device process. Therefore, how to design a voltage reference circuit without using bipolar device is desired.

SUMMARY OF INVENTION

The invention provides a circuit for producing a voltage reference, which can be fabricated under the CMOS process and is insensitive to the temperature, so that the circuit can be easily fabricated with a stable voltage level without being affected by the environmental temperature.

As embodied and broadly described herein, the invention provides a circuit for producing a voltage reference insensitive to temperature. The circuit includes a current source unit, a voltage-difference creating unit, and a resistance ratio unit. The current source unit receives an input current source and also receives a feedback signal from the resistance ratio unit. The current source unit thereby produces a first current source and a second current source which are equal in current. The voltage-difference creating unit includes a first MOS device and a second MOS device to respectively receive the first current source and the second source, wherein the first MOS device and a second MOS device has a threshold voltage difference. The resistance ratio unit includes a first resistor and a second resistor coupled in cascade, wherein the threshold voltage difference is applied to the first resistor. By adjusting a ratio of the first resistor to the second resistor, the resistance ratio unit produces a voltage reference, which is also the feedback signal to the current source unit.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION

The present invention is using the properties of threshold voltage for the metal-oxide semiconductor (MOS) device, so that for example two MOS transistors with different threshold voltages are used to create a stable voltage difference insensitive to the temperature. The voltage difference is used to adjust up to the desired voltage reference. The features of being insensitive to temperature are achieved due to the variation of the threshold voltage of the MOS device is a log relation. After subtraction of the threshold voltages between two MOS device, the result becomes small and insensitive to the temperature. The physical mechanism associating with the circuit design is to be described by using an example as follows.

Figure 1:
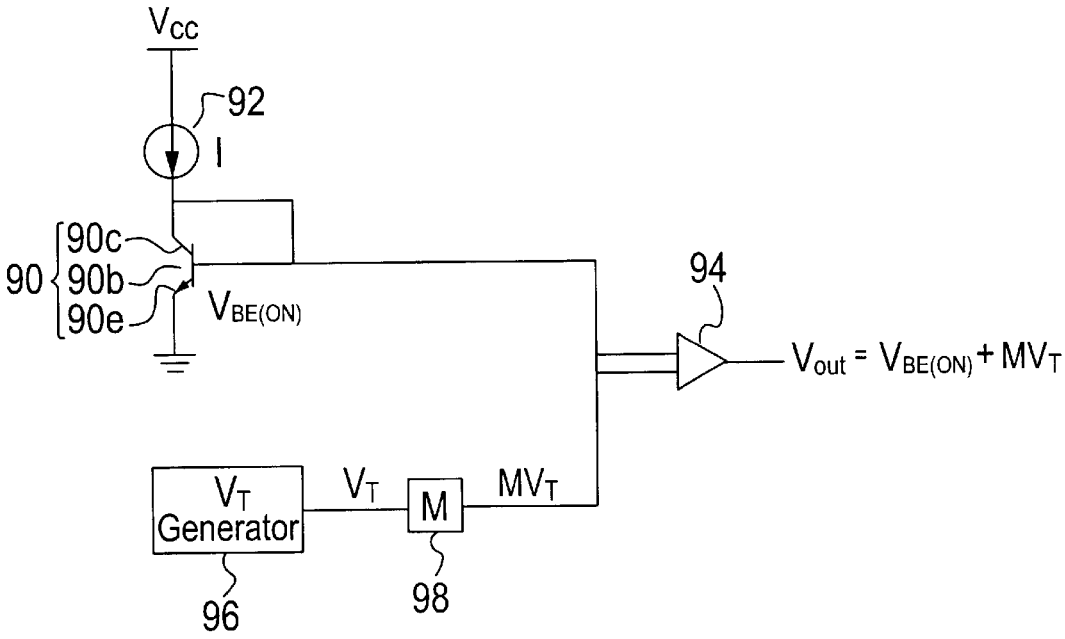
FIG. 1 (PRIOR ART)
FIG. 1 is a block diagram, schematically illustrating a conventional circuit architecture using bipolar device to produce a voltage reference.
Figure 2:
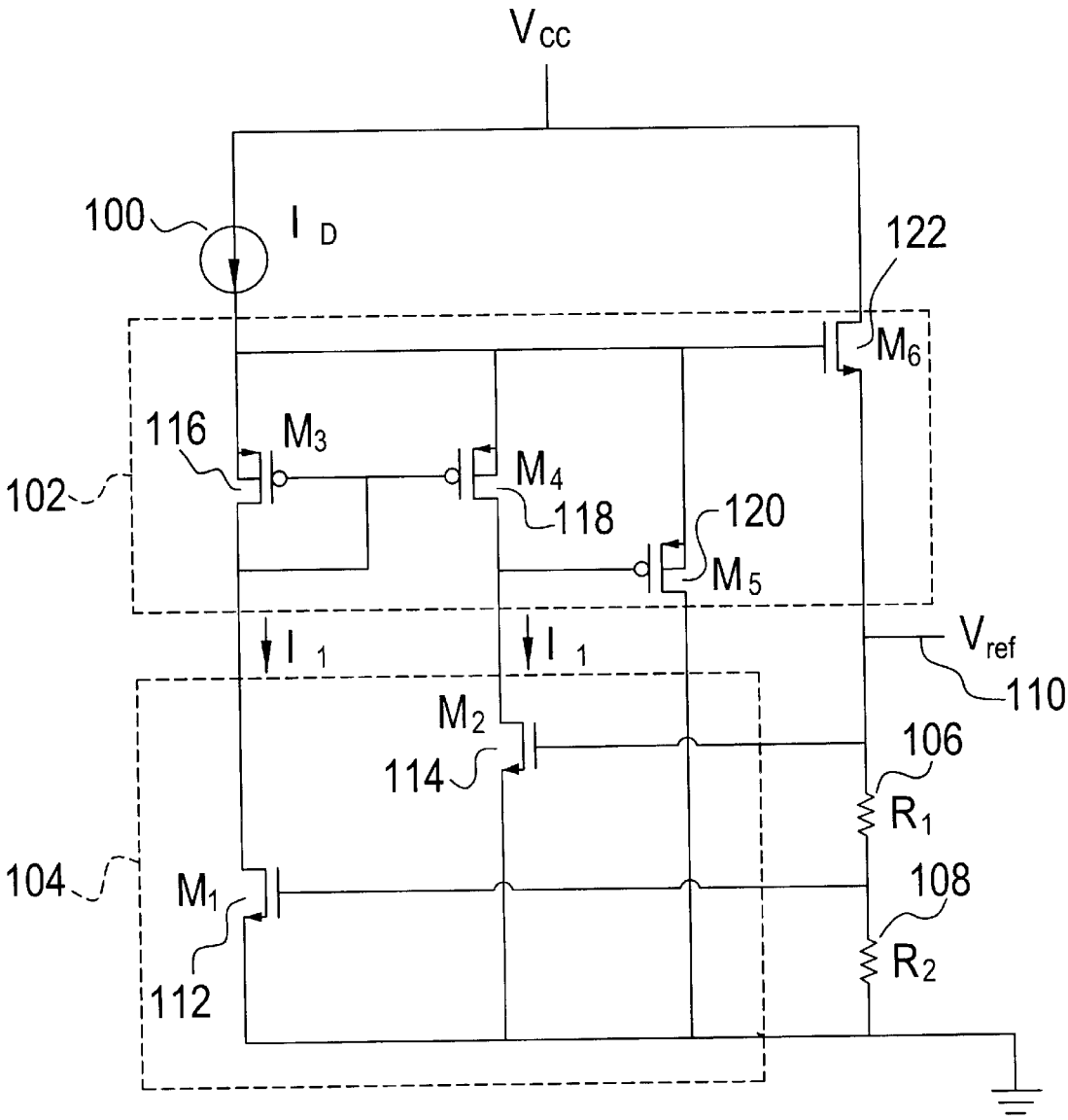
FIG. 2 is a circuit architecture, schematically illustrating a circuit design for producing a voltage reference insensitive to temperature, according to one preferred embodiment of this invention.

FIG. 2 is a circuit architecture, schematically illustrating a circuit design for producing a voltage reference insensitive to temperature, according to one preferred embodiment of this invention. In FIG. 2, according to the design principle, the circuit architecture for producing the stable voltage reference includes a current source unit 102, a voltage-difference creating unit 104, and a resistance ratio unit that may includes, for example, two resistors 106, 108 coupled in cascade.

The general design principle is following. The current source unit 102 receives an input current source $I_D$ 100 and produces two current sources $I_1$ in equal current. The voltage-difference creating unit 104 includes, for example, a first MOS device M1 112 and a second MOS device M2 114 to respectively receive the two current sources $I_1$, wherein the first MOS device M1 112 and a second MOS device M2 114 have different threshold voltages, so as to produce a threshold voltage difference. The resistance ratio unit includes, for example, the first resistor R1 106 and the second resistor R2 108 coupled in cascade, wherein the threshold voltage difference, produced by the voltage-difference creating unit 104, is applied to the first resistor R1 106, for example. By adjusting a ratio of the first resistor R1 106 to the second resistor R2 108, the resistance ratio unit produces a voltage reference Vref 110, which is also fed back to the current source unit 102 to ensure that the first current source and the second current source are equal. The detailed design as an example is further described as follows.

First, the voltage-difference creating unit 104 includes, for example, at least two MOS transistors 112, 114, which are fabricated by different threshold voltage. In the circuit, the MOS transistor M1 112 is set to have lower threshold voltage. According to the fabrication process for the complementary MOS device, the MOS transistor M1 112 can be formed by a standard process but only requiring an extra implantation mask for adjusting the threshold voltage of the MOS transistor M1 112.

In FIG. 2, one source/drain region of the MOS transistor M1 112 receives one current source $I_1$. Likewise, one source/drain region of the MOS transistor M2 114 receives another current source $I_1$. The other source/drain region of the MOS transistor M1 112 and the other source/drain region of the MOS transistor M2 114 are grounded. Here in the example, the MOS transistor M1 112 and the MOS transistor M2 114 can be, for example, two n-type MOS (NMOS) transistors.

The resistance ratio unit includes the first resistor R1 106 and the second resistor R2 108 coupled in cascade. In design, the threshold-voltage difference from the voltage-difference creating unit 104 is applied on the first resistor R1 106 between two terminals. That is, the gate electrode of the second MOS transistor M2 114 is connected to one terminal of the first resistor R1 106, wherein the gate electrode is also connected to the output node for exporting the resided voltage reference Vref 110. The gate electrode of the first MOS transistor M1 112 is connected to the other terminal of the first resistor R1 106 and one terminal of the second resistor R2 108. The other terminal of the second resistor R2 108 is then grounded.

In the foregoing circuit design, the desired voltage reference Vref can be adjusted from a ratio of the first resistor R1 106 and the second resistor R2 108. The relation is derived as shown in eq. (1)

$$V_{ref}=(V_{t2}-V_{t1})\cdot(1+R2/R1). \tag{1}$$

where Vt1 and Vt2 are the threshold voltages, respectively, of the first MOS transistor M1 112 and the second transistor M2 114. The voltage reference Vref is as a function of the ratio R2/R1. It allows the desired voltage reference to be adjusted. According to the eq. (1), the temperature relation is obtained as shown in eq. (2):

$$\frac{dV_{ref}}{dT}=\left(\frac{dV_{t2}}{dT}-\frac{dV_{t1}}{dT}\right)\cdot\left(1+\frac{R_2}{R_1}\right). \tag{2}$$

Since the difference between Vt1 and Vt2 comes from substrate densities and the terms of $$\frac{dV_{t2}}{dT} \text{ and } \frac{dV_{t1}}{dT}$$

related to the substrate densities in mathematical form are the log quantities, the subtraction is transformed into a dividing relation. As a result, the quantity of $$\frac{dV_{t2}}{dT}-\frac{dV_{t1}}{dT}$$

is greatly reduced. Therefore, the voltage reference Vref is insensitive to the temperature.

In order to make use of the difference of the threshold voltages between two MOS devices M1 112 and M2 114, the current source unit 102 is required to produce two identical currents $I_1$. However, in order to maintain the same current, some feed back routes from the voltage reference are necessary. The current source unit 102 can be designed, for example, as shown in FIG. 2.

The current source unit 102, for example, includes a first P-type MOS (PMOS) transistor M3 116, a second PMOS transistor M4 118, a PMOS transistor M5 120, and a feedback NMOS transistor M6 122. Basically, the first PMOS transistor M3 116 and the second PMOS transistor M4 118 are respectively used to produce the two current sources from the input current source $I_D$ 100. However, in order to maintain the first PMOS transistor M3 116 and the second PMOS transistor M4 118 to have the same current, the PMOS transistor M5 120, and the feedback NMOS transistor M6 122 are separately used to form the feedback routes to the first PMOS transistor M3 116 and the second PMOS transistor M4 118. The feedback routes are also essential to maintain the same current. If the two current sources from the first PMOS transistor M3 116 and the second PMOS transistor M4 118 are not equal, the voltage reference will be affected.

The detailed circuit architecture of the current source unit 102 is following. The first P-type MOS (PMOS) transistor M3 116 has a first source/drain electrode, a second source/drain electrode, a gate electrode, and a substrate electrode. Since the source region and the drain region of a MOS transistor usually are interchangeable, the source or drain can be determined from the actual design. The first source/drain electrode receives the input current source $I_D$ 100. The gate electrode is coupled to the second source/drain electrode of the first PMOS transistor M3 116 and exports the first current source $I_1$ .

The second PMOS transistor M4 118 also has a first source/drain electrode, a second source/drain electrode, a gate electrode, and a substrate electrode. The gate electrode is also coupled to the gate electrode of the first PMOS transistor M3 116. The first source/drain electrode receives the input current source $I_D$ 100 and is also coupled to the substrate electrode. The second source/drain electrode of the second PMOS transistor M4 118 exports the second current source $I_1$.

The feedback PMOS transistor M5 120 has a first source/drain electrode, a second source/drain electrode, a gate electrode, and a substrate electrode. The first source/drain electrode receives the input current source $I_D$ 100 and is coupled to the substrate electrode. The gate electrode of the feedback PMOS transistor M5 120 is coupled to the second source/drain region of the second PMOS transistor M4 118. Then the second source/drain electrode is grounded. The feedback PMOS transistor M5 120 serves as a feedback route to the first P-type MOS (PMOS) transistor M3 116 and the second PMOS transistor M4 118.

The feedback NMOS transistor M6 122 has a first source/drain electrode, a second source/drain electrode, and a gate electrode. The first source/drain electrode receives the system voltage source Vcc, the gate electrode receives the input current source $I_D$ 100, and the second source/drain electrode receives the voltage reference Vref, which is fed back from the resistor R1 106. As a result from the feedback PMOS transistor M5 120 and the feedback NMOS transistor M6 122, the two current sources can be maintained to be the same current $I_1$. And then, the voltage reference Vref can be stable and insensitive to the temperature.

In summary, the present invention use the difference of threshold voltages for the MOS device, so as to obtain a reference, which is insensitive to the temperature. The threshold voltage can be adjusted by using an implantation photomask. The actually desired voltage reference can be obtained by adjusting from the threshold voltage reference. Also and, as known by the skilled artisans, the conductive n-type or p-type of the MOS devices in the foregoing circuit can be changed according to the actual design. The current source unit 102 is designed to produce two current sources with the same current. The current source unit 102 receives the feedback of current source and voltage reference, so that the two current sources remain substantially the same current.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims and their equivalents.

What is claimed is:

1. A circuit architecture for producing a voltage reference insensitive to temperature, the circuit architecture comprising:

a current source unit, which receives an input current source and a system voltage source, and is used to produce a first current source and a second current source in equal current;

a voltage-difference creating unit, receiving the first current source and the second current source, wherein the voltage-difference creating unit includes a plurality of metal-oxide semiconductor (MOS) devices to produce a threshold-voltage difference; and a resistance ratio unit, receiving the threshold-voltage difference from the voltage-difference creating unit as a reference, so as to produce the voltage reference, wherein the voltage reference is also fed back to the current source unit to be used for ensuring that the first current source and the second current source are equal in current.

2. The circuit architecture of claim 1, wherein the voltage-difference creating unit includes a first MOS device and a second MOS device respectively receiving the first current source and the second current source, wherein the first MOS device and the second MOS device produce the threshold-voltage difference.

3. The circuit architecture of claim 2, wherein the first MOS device and the second MOS device are two n-type MOS transistors but the first MOS device is lower in threshold voltage than the second MOS device.

4. The circuit architecture of claim 1, wherein the resistance ratio unit includes a first resistor and a second resistor coupled in cascade, wherein the threshold-voltage difference from the voltage-difference creating unit is applied on the first resistor between a first terminal and a second terminal thereof, wherein the first terminal exports the voltage reference and the second terminal is coupled to the second resistor.

5. The circuit architecture of claim 1, wherein the current source unit comprises:

a first P-type MOS (PMOS) transistor, having a first source/drain electrode, a second source/drain electrode, a gate electrode, and a substrate electrode, wherein the first source/drain electrode receives the input current source, the gate electrode is coupled to the second source/drain electrode, which exports the first current source;

a second PMOS transistor, having a first source/drain electrode, a second source/drain electrode, a gate electrode, and a substrate electrode, wherein the gate electrode is also coupled to the gate electrode of the first PMOS transistor, the first source/drain electrode receives the input current source and is coupled to the substrate electrode, and the second source/drain electrode exports the second current source;

a feedback PMOS transistor, having a first source/drain electrode, a second source/drain electrode, a gate electrode, and a substrate electrode, wherein the first source/drain electrode receives the input current source and is coupled to the substrate electrode, the gate electrode is coupled to the second source/drain region of the second PMOS transistor, the second source/drain electrode is grounded; and a feedback n-type MOS (NMOS) transistor, having a first source/drain electrode, a second source/drain electrode, and a gate electrode, wherein the first source/drain electrode receives the system voltage source, the gate electrode receives the input current source, and the second source/drain electrode receives the voltage reference fed back from the resistance ratio unit.

6. A circuit architecture for producing a voltage reference insensitive to temperature, the circuit architecture comprising:

a current source unit, which receives an input current source and a system voltage source, and is used to produce a first current source and a second current source in substantially equal current, wherein the current source unit including:

a first P-type MOS (PMOS) transistor, having a first source/drain electrode, a second source/drain electrode, a gate electrode, and a substrate electrode, wherein the first source/drain electrode receives the input current source, the gate electrode is coupled to the second source/drain electrode, which exports the first current source;

a second PMOS transistor, having a first source/drain electrode, a second source/drain electrode, a gate electrode, and a substrate electrode, wherein the gate electrode is also coupled to the gate electrode of the first PMOS transistor, the first source/drain electrode receives the input current source and is coupled to the substrate electrode, and the second source/drain electrode exports the second current source;

a feedback PMOS transistor, having a first source/drain electrode, a second source/drain electrode, a gate electrode, and a substrate electrode, wherein the first source/drain electrode receives the input current source and is coupled to the substrate electrode, the gate electrode is coupled to the second source/drain region of the second PMOS transistor, the second source/drain electrode is grounded; and a feedback n-type MOS (NMOS) transistor, having a first source/drain electrode, a second source/drain electrode, and a gate electrode, wherein the first source/drain electrode receives the system voltage source, the gate electrode receives the input current source, and the second source/drain electrode connected to an output node that exports the voltage reference;

a voltage-difference creating unit, includes two metal-oxide semiconductor (MOS) transistor units respectively receiving the first current source and the second current source, so as to produce a threshold-voltage difference; and the resistance ratio unit, receiving the threshold-voltage difference from the voltage-difference creating unit as a reference, so as to produce the voltage reference to output node and feed to the feedback NMOS transistor in the current source unit.

7. The circuit architecture of claim 6, wherein in the voltage-difference creating unit, one of the two MOS transistor units coupled to the first current source is lower in threshold voltage than another one of the two MOS transistor units coupled to the second current source.

* * * * *